US011621489B2

(12) United States Patent
Hamabe

(10) Patent No.: US 11,621,489 B2
(45) Date of Patent: Apr. 4, 2023

(54) ANTENNA DEVICE

(71) Applicant: Panasonic Intellectual Property Management Co., Ltd., Osaka (JP)

(72) Inventor: Taichi Hamabe, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 51 days.

(21) Appl. No.: 17/236,566

(22) Filed: Apr. 21, 2021

(65) Prior Publication Data

US 2021/0336340 A1 Oct. 28, 2021

(30) Foreign Application Priority Data

Apr. 24, 2020 (JP) ..... JP2020-077429

(51) Int. Cl.
*H01Q 5/378* (2015.01)
*H01Q 13/28* (2006.01)
*H01Q 21/00* (2006.01)

(52) U.S. Cl.
CPC ..... *H01Q 5/378* (2015.01); *H01Q 13/28* (2013.01); *H01Q 21/0006* (2013.01)

(58) Field of Classification Search
CPC .... H01Q 5/378; H01Q 13/28; H01Q 21/0006; H01Q 1/2291; H01Q 1/38; H01Q 15/0006; H01Q 19/108; H01Q 9/065
See application file for complete search history.

(56) References Cited

U.S. PATENT DOCUMENTS

2018/0183142 A1* 6/2018 Hamabe ..... H01Q 9/065
2018/0205145 A1* 7/2018 Hamabe ..... H01Q 1/48
2020/0196439 A1* 6/2020 Hamabe ..... H01Q 5/378

FOREIGN PATENT DOCUMENTS

JP 2015-70542 4/2015

* cited by examiner

*Primary Examiner* — Andrea Lindgren Baltzell
(74) *Attorney, Agent, or Firm* — Wenderoth, Lind & Ponack, L.L.P.

(57) ABSTRACT

Provided is an antenna device including a feeding antenna conductor, a non-feeding antenna conductor, a ground conductor, and an artificial magnetic conductor disposed between the feeding antenna conductor and the non-feeding antenna conductor, and the ground conductor. The antenna device further includes a conductor that electrically connects the artificial magnetic conductor to the ground conductor. The conductor is disposed at a position opposite to the feeding antenna conductor with respect to the non-feeding antenna conductor, and is separated from the non-feeding antenna conductor.

14 Claims, 10 Drawing Sheets

ANTENNA DEVICE

BACKGROUND

1. Technical Field

The present disclosure relates to an antenna device.

2. Description of the Related Art

Unexamined Japanese Patent Publication No. 2015-70542 discloses an antenna device using an artificial magnetic conductor (hereinafter referred to as an AMC).

SUMMARY

The present disclosure provides an antenna device that achieves miniaturization while maintaining frequency characteristics of a fundamental wave at an operating frequency.

An antenna device according to the present disclosure includes a feeding antenna conductor, a non-feeding antenna conductor, a ground conductor, and an artificial magnetic conductor disposed between the feeding antenna conductor and the non-feeding antenna conductor, and the ground conductor. The antenna device further includes a conductor that electrically connects the artificial magnetic conductor to the ground conductor. The conductor is disposed at a position opposite to the feeding antenna conductor with respect to the non-feeding antenna conductor, and is separated from the non-feeding antenna conductor.

According to the present disclosure, the antenna device can be miniaturized while maintaining frequency characteristics of a fundamental wave at an operating frequency.

DETAILED DESCRIPTION

Hereinafter, exemplary embodiments specifically disclosing an antenna device according to the present disclosure will be described in detail with reference to the drawings as appropriate. However, an unnecessarily detailed description may be eliminated. For example, detailed description of a well-known item or duplicated description of substantially identical structure may be eliminated. This is to prevent the following description from being unnecessarily redundant to facilitate understanding of those skilled in the art. The attached drawings and the following description are provided for those skilled in the art to fully understand the present disclosure, and are not intended to limit the subject matter described in the scope of claims.

First Exemplary Embodiment

In a first exemplary embodiment, an antenna device in the 2.4 GHz band (e.g., 2400 to 2500 MHz), such as an antenna device for Bluetooth (registered trademark), an antenna device for Wi-Fi (registered trademark), or an antenna device for various electronic devices, will be described below as an example. However, the antenna device can be similarly used in other frequency bands. For example, the antenna device is disposed in a housing of a seat monitor attached to a back face of a backrest of a passenger seat disposed in an aircraft. The antenna device radiates a radio wave in the 2.4 GHz band, for example, from a front face (e.g., a monitor screen) of the seat monitor toward a front direction of a rear seat. The electronic device in which the antenna device is disposed is not limited to the seat monitor described above.

Figure 1:
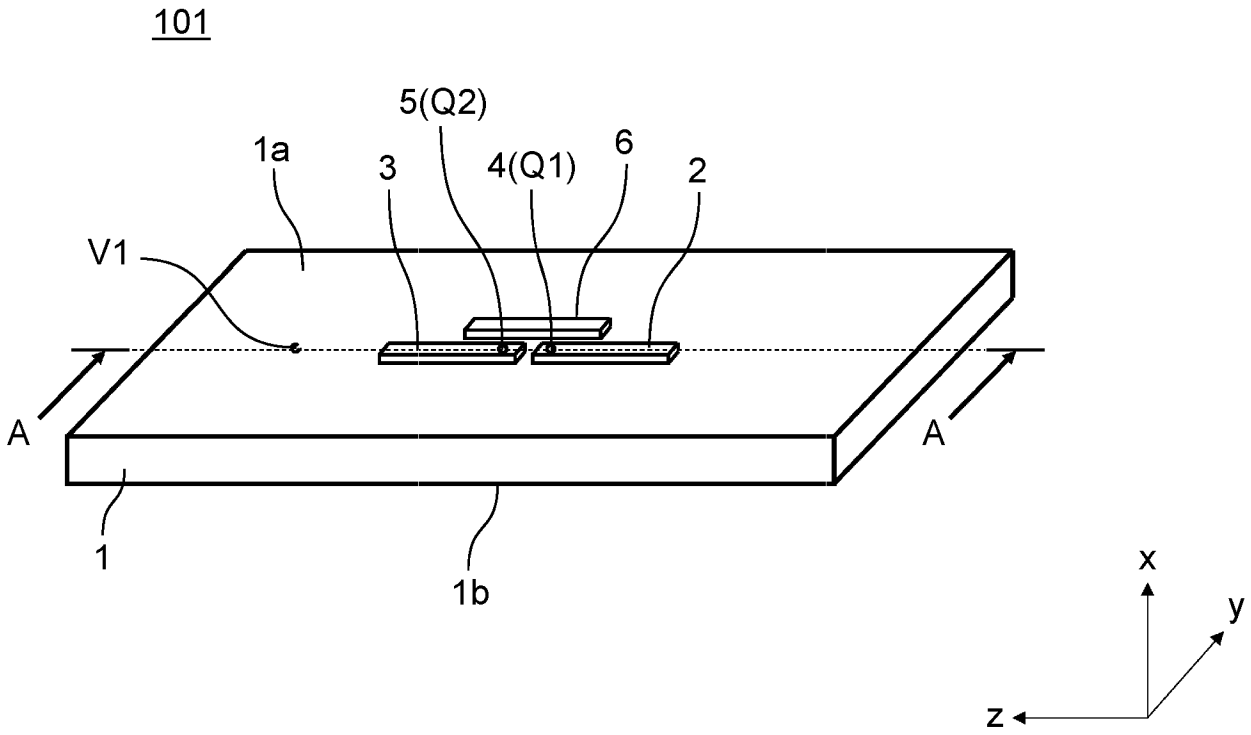
FIG. 1 is a perspective view illustrating an outer appearance of an antenna device according to a first exemplary embodiment.
Figure 2:
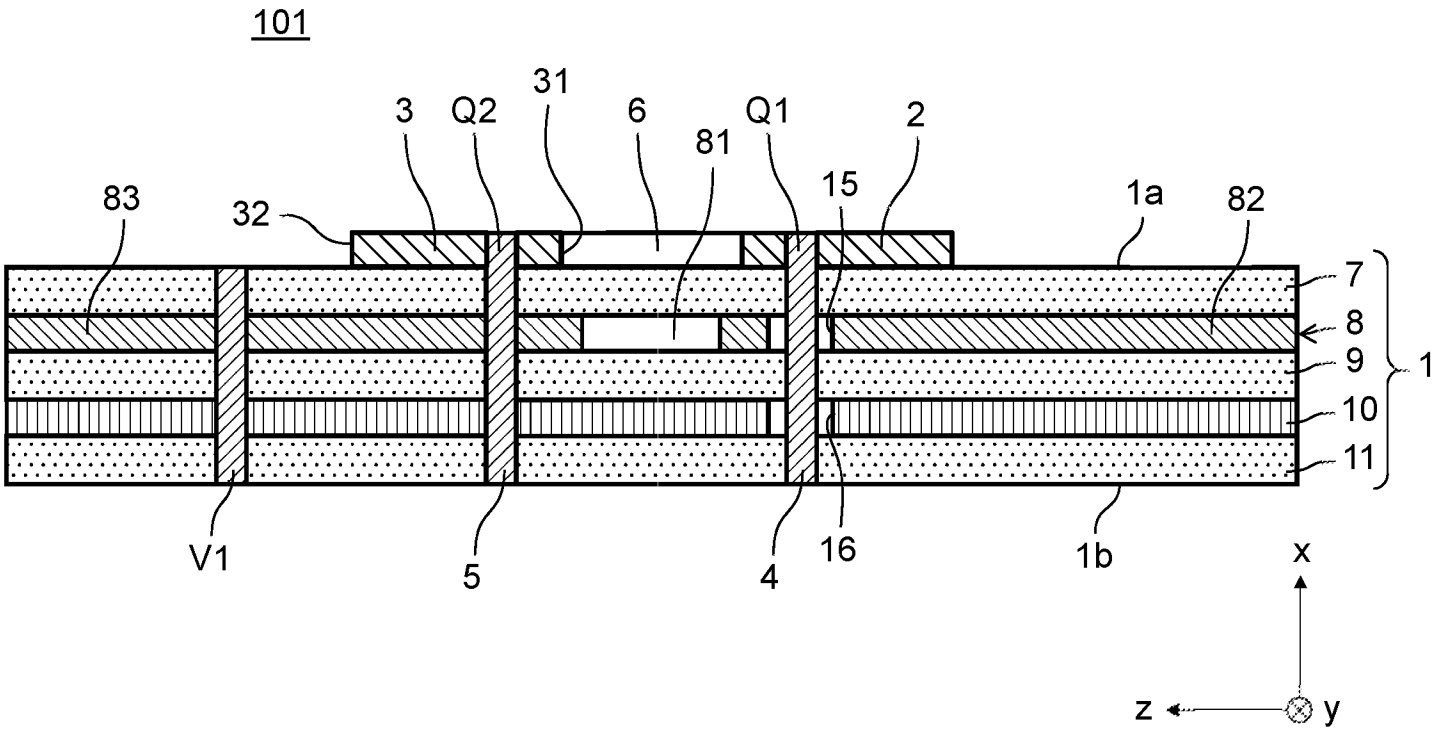
FIG. 2 is a longitudinal sectional view illustrating an internal structure of the antenna device taken along line A-A of FIG. 1.
Figure 3:
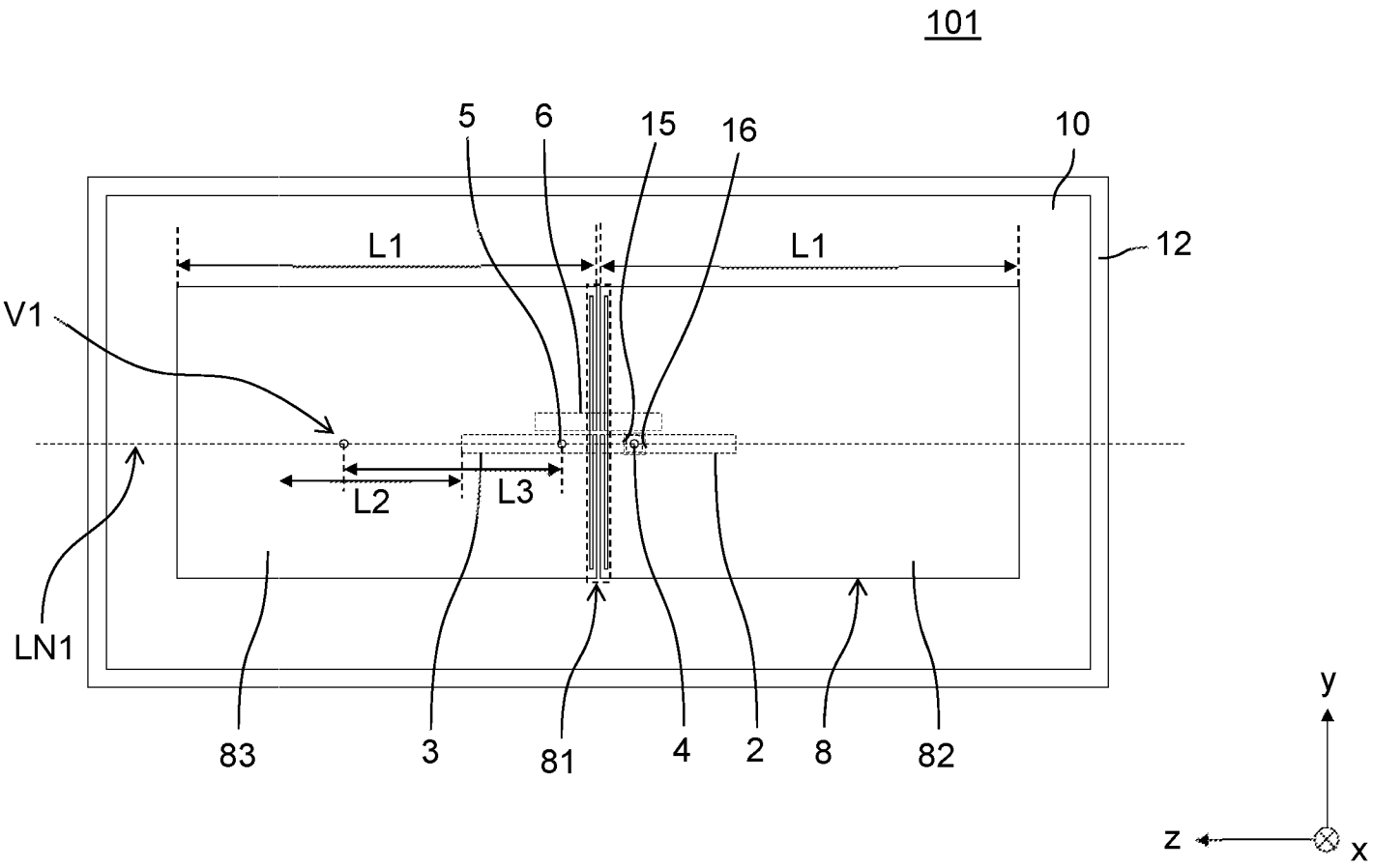
FIG. 3 is a perspective plan view of the antenna device according to the first exemplary embodiment as viewed from above.

FIG. 1 is a perspective view illustrating an outer appearance of antenna device 101 according to the first exemplary embodiment. FIG. 2 is a longitudinal sectional view illustrating an internal structure of antenna device 101 taken along line A-A of FIG. 1. FIG. 3 is a perspective plan view of antenna device 101 according to the first exemplary embodiment as viewed from above. In the description of FIGS. 2 and 3, the same elements as those of FIG. 1 are designated by the same reference numerals to simplify or eliminate description, and different contents will be described.

In the first exemplary embodiment, an x-axis, a y-axis, and a z-axis follow an illustration in FIG. 1. The x-axis indicates a thickness direction of printed-circuit board 1 of antenna device 101. The y-axis indicates a width direction of printed-circuit board 1 of antenna device 101. The z-axis indicates a longitudinal direction of printed-circuit board 1 of antenna device 101.

In the exemplary embodiment below, a dipole antenna will be described as an example of the antenna device. The dipole antenna is formed on printed-circuit board 1 that is a layered board having multiple layers. The dipole antenna has a pattern that is formed by etching metal foil on a surface of printed-circuit board 1. The multiple layers are each made of copper foil or glass epoxy, for example.

As illustrated in FIG. 1, antenna device 101 includes printed-circuit board 1, antenna conductor 2 that is a strip conductor as an example of a feeding antenna, antenna conductor 3 that is a strip conductor as an example of a non-feeding antenna, and parasitic conductor 6 that is disposed laterally to antenna conductors 2, 3. Printed-circuit board 1 of antenna device 101 is mounted on a printed-circuit board of an electronic device such as a seat monitor.

Antenna conductors 2, 3 are connected to via conductors 4, 5 of printed-circuit board 1, respectively. Via conductor 4 (an example of a fifth via conductor) is formed using, for example, copper foil with conductivity, and constitutes a feeder between feeding point Q1 of antenna conductor 2 and a radio communication circuit (not illustrated; e.g., a signal source circuit mounted on back surface 1*b* of printed-circuit board 1). As illustrated in FIG. 2, via conductor 4 is electrically connected to antenna conductor 2 and electrically insulated from ground conductor 10 and AMC 8. Via conductor 5 (an example of a sixth via conductor) is formed using, for example, copper foil with conductivity, and constitutes a ground line between feeding point Q2 of antenna conductor 3 and the above-described radio communication circuit (not illustrated). As illustrated in FIG. 2, via conductor 5 is electrically connected to antenna conductor 3 and electrically connected to ground conductor 10 and AMC 8.

Antenna conductors 2, 3 each have a substantially rectangular shape (including a rectangular shape), forming a dipole antenna, for example, and each have a longitudinal direction extending on a straight line in z-direction. Each of antenna conductor 2 and antenna conductor 3 is formed on front surface 1*a* of printed-circuit board 1. To minimize cancellation of radio waves radiated from respective antenna conductors 2, 3, an end of antenna conductor 2, close to feeding point Q1, is separated from end 31 (feeding-side end) of antenna conductor 3, close to feeding point Q2, by a predetermined interval. As illustrated in FIG. 1, the end of antenna conductor 2, close to feeding point Q1, faces end 31 of antenna conductor 3, close to feeding point Q2.

Antenna conductors 2, 3 have ends opposite to the corresponding feeding-side ends (specifically, the ends separated maximumly from each other when antenna device 101 is viewed in plan) that are referred to below as "leading-side ends" of antenna conductors 2, 3. As illustrated in FIG. 2, the leading-side end of antenna conductor 3 is end 32. Via conductor 5 is electrically connected to antenna conductor 3 at a position closer to end 31 than end 32.

Parasitic conductor 6 is disposed parallel to a placement direction (z-direction) of each of antenna conductors 2, 3, and is disposed close to one of side surfaces of each of antenna conductors 2, 3 to be electrically separated from antenna conductors 2, 3. A predetermined distance is secured between parasitic conductor 6 and antenna conductor 2 as well as between parasitic conductor 6 and antenna conductor 3 to similarly minimize cancellation of radio waves radiated from antenna conductors 2, 3. The predetermined distance is, for example, a distance within a quarter of one wavelength of radio waves in an operating frequency band supported by antenna device 101. Parasitic conductor 6 is electrostatically coupled to AMC 8 as with antenna conductors 2, 3, so that capacitance between antenna conductors 2, 3 and AMC 8 can be increased to shift an operating frequency to a low-frequency side. Parasitic conductor 6 is electrically separated from antenna conductors 2 and 3. That is, parasitic conductor 6 is not electrically connected to either via conductor 4 or via conductor 5.

Parasitic conductor 6 in not particularly limited in size, shape, number, etc., and parasitic conductor 6 is only required to be electrostatically coupled to AMC 8 while being located on the same side as antenna conductors 2, 3 when viewed from AMC 8. Thus, parasitic conductor 6 is not necessarily placed directly above AMC 8.

Via conductors 4, 5 are each formed by filling a conductor such as copper foil in a through-hole formed in the thickness direction (x-direction) from front surface 1*a* to back surface 1*b* of printed-circuit board 1. Via conductors 4, 5 are formed directly below feeding points Q1, Q2, respectively, at positions substantially facing each other. Antenna conductor 2 functions as a feeding antenna, and thus is connected to a feeding terminal of the radio communication circuit (refer to the above description) on back surface 1*b* of printed-circuit board 1 with via conductor 4. Antenna conductor 3 functions as a non-feeding antenna, and thus is connected to ground conductor 10 in printed-circuit board 1 and a ground terminal of the radio communication circuit (refer to the above description) with via conductor 5.

In the first exemplary embodiment, via conductor V1 is provided at a position separated from antenna conductor 3 in a direction opposite to antenna conductor 2. Via conductor V1 is formed using, for example, conductive copper foil, and constitutes a ground wire between AMC 8 and ground conductor 10 (refer to FIG. 2). In the first exemplary embodiment, it is found that providing via conductor V1 enables an operating frequency of antenna device 101 to be shifted further to a low-frequency side as compared with when via conductor V1 is not provided. This means that an operating frequency at which a minimum value (peak) is obtained is shifted to a low-frequency side in voltage standing wave ratio (VSWR) characteristics of FIG. 10. It is considered that the shift to the low-frequency side is caused by, for example, via conductor V1 that is provided to shift (change) a path (area) of a current flowing from antenna conductor 3 to AMC 8 and ground conductor 10 to cover a wider area.

FIG. 2 illustrates printed-circuit board 1 that includes dielectric board 7, artificial magnetic conductor (AMC) 8, dielectric board 9, ground conductor 10, and dielectric board 11, being layered in this order. The layered structure of printed-circuit board 1 is an example. Here, each of dielectric boards 7, 9, 11 has insulating properties against a direct-current component, and is made of, for example, glass epoxy.

AMC 8 is an artificial magnetic conductor having perfect magnetic conductor (PMC) characteristics and is formed of a predetermined metal pattern. AMC 8 is electrostatically coupled to each of antenna conductors 2, 3 and parasitic conductor 6, and thus enables the antenna to be thin and to have a high gain. AMC 8 is provided in its intermediate portion between via conductors 4, 5 facing in z-axis direction with slit 81 that passes through AMC 8 in the thickness direction (x-axis direction) and extends to near an end of AMC 8 in the width direction (y-axis direction) (refer to FIG. 3). In the first exemplary embodiment, slit 81 has a shape in which three slits are connected in a central portion in the width direction (refer to FIG. 3).

AMC 8 also includes a hole for slit 81, via conductor insulating hole 15 formed to allow via conductor 4 to pass through while being electrically insulated from AMC 8, a hole that allows via conductor 5 to pass through and is electrically connected to AMC 8, and a hole that allows via conductor V1 to pass through and is electrically connected to AMC 8.

Via conductor 4 having a cylindrical column shape is a feeder for supplying electric power to drive antenna conductor 2 as an antenna, and electrically connects antenna conductor 2 formed on front surface 1*a* of printed-circuit board 1 to the feeding terminal of the radio communication circuit (refer to the above description). Via conductor 4 is formed substantially coaxially with via conductor insulating holes 15, 16 formed in AMC 8 and ground conductor 10, respectively, to be not electrically connected to AMC 8 and ground conductor 10. Thus, via conductor 4 has a diameter smaller than a diameter of each of via conductor insulating holes 15, 16.

Via conductor 5 having a cylindrical column shape is a ground wire for electrically connecting antenna conductor 3 to the ground terminal of the radio communication circuit (refer to the above description), and electrically connects antenna conductor 3 formed on front surface 1*a* of printed-circuit board 1 to the ground terminal of the radio communication circuit (refer to the above description). Via conductor 5 is electrically connected to each of AMC 8 and ground conductor 10.

Via conductor V1 having a cylindrical column shape electrically connects AMC 8 to ground conductor 10, as with via conductor 5.

Ground conductor 10 includes via conductor insulating hole 16 formed to allow via conductor 4 to pass through while being electrically insulated from ground conductor 10, a first hole that allows via conductor 5 to pass through and is electrically connected to ground conductor 10, and a second hole that allows via conductor V1 to pass through and is electrically connected to ground conductor 10.

FIG. 3 mainly illustrates AMC 8 and ground conductor 10, in plan view, and thus antenna conductors 2, 3, parasitic conductor 6, and via conductor insulating holes 15, 16 are each illustrated with a broken line to be transparently illustrated. Slit 81 is formed in a central portion of AMC 8, so that AMC 8 is composed of two parts. A first part is provided corresponding to antenna conductor 2, and a second part is provided corresponding to antenna conductor 3. That is, as illustrated in FIG. 3, AMC 8 includes two artificial magnetic conductors (first artificial magnetic conductor 82, second artificial magnetic conductor 83) and slit 81 located between the two artificial magnetic conductors. Here, as illustrated in FIG. 2, first artificial magnetic conductor 82 is disposed between antenna conductor 2 and ground conductor 10. Second artificial magnetic conductor 83 is disposed between antenna conductor 3 and ground conductor 10. Antenna device 101 according to the first exemplary embodiment includes ground conductor 10 configured to have a larger area than AMC 8. Ground conductor 10 may be layered on component mounting surface 12 having a larger area than ground conductor 10 with a dielectric board similar to dielectric board 7 or the like, being interposed between ground conductor 10 and component mounting surface 12.

Here, the first part and the second part of AMC 8 each has a side in the longitudinal direction, having a length indicated as L1. When L1 is shortened, an area of AMC 8 is reduced. This causes the amount of electrostatic coupling between antenna conductors 2, 3 and AMC 8 to be reduced, so that the operating frequency of antenna device 101 is shifted to a high-frequency side. As described above, in the first exemplary embodiment, providing via conductor V1 enables the operating frequency of antenna device 101 to be shifted further to a low-frequency side as compared with when via conductor V1 is not provided. Thus, when via conductor V1 is provided as in the first exemplary embodiment, AMC 8 can be shortened in antenna device 101, and thus printed-circuit board 1 can be made smaller. That is, antenna device 101 can be miniaturized.

When via conductor V1 is provided and L1 is shortened, the operating frequency of antenna device 101 is shifted to the high-frequency side as compared with when L1 is a length before being shortened.

In the first exemplary embodiment, via conductor V1 is provided, for example, at a position separated from a feeding-side end of antenna conductor 3, or from a position of a contact point where via conductor 5 is in contact with antenna conductor 3, by about length L3 in the direction opposite to antenna conductor 2 (i.e., +z-direction) with respect to virtual line LN1 coaxial with antenna conductors 2, 3. L3 is approximately half in length of L1. That is, via conductor V1 is disposed at a position that is not close to antenna conductor 2 as an example of a feeding antenna, but close to antenna conductor 3 as an example of a non-feeding antenna, the position being separated from antenna conductor 3 by a predetermined distance in +z-direction. As an example, a distance between via conductor 5 and via conductor V1 may be half of length L1 of one side in a longitudinal direction of first artificial magnetic conductor 83 of AMC 8. Here, the longitudinal direction of first artificial magnetic conductor 83 is a direction along virtual line LN1.

In particular, when L1 is a fixed length and via conductor V1 is provided at a position changed in +z-direction from the position illustrated in FIG. 3, the operating frequency of antenna device 101 is shifted to the high-frequency side. In contrast, when L1 is a fixed length and via conductor V1 is provided at a position changed in −z-direction from the position illustrated in FIG. 3, the operating frequency of antenna device 101 is shifted to the low-frequency side. The position of via conductor V1 can be adjusted to any position within a range of length L2 illustrated in FIG. 3. Length L2 is shorter than a length of a side of antenna conductor 3 in the longitudinal direction (e.g., L1 illustrated in FIG. 3) (L2<L1). This enables radio communication to be implemented in accordance with a desired operating frequency of antenna device 101 by adjusting a position of via conductor V1. Shortening a length L1 also enables antenna device 101 to be miniaturized.

Next, an example of VSWR characteristics of antenna device 101 according to the first exemplary embodiment will be described with reference to FIG. 10.

Figure 10:
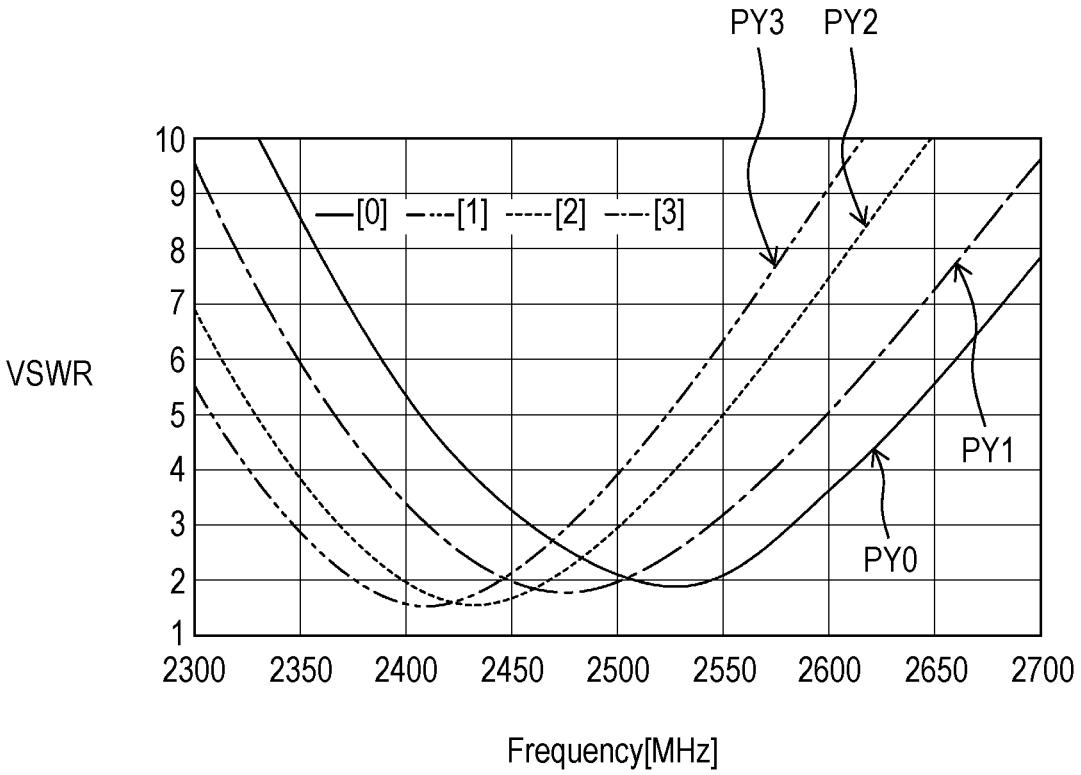
FIG. 10 is a diagram showing a simulation example of frequency characteristic of a voltage standing wave ratio in the antenna devices according to the first and second exemplary embodiments.

FIG. 10 is a diagram showing a simulation example of frequency characteristic of a voltage standing wave ratio in the antenna devices according to the first and second exemplary embodiments. FIG. 10 has a horizontal axis representing frequency [MHz], and a vertical axis representing VSWR. The illustration of FIG. 10 according to the first exemplary embodiment includes characteristics PY0 and characteristics PY2, and thus these two characteristics will be described.

Characteristics PY0 indicate the VSWR characteristics when via conductor V1 is not provided in antenna device 101 according to the first exemplary embodiment (i.e., the VSWR characteristics of a comparative example). Characteristics PY2 indicate the VSWR characteristics when via conductor V1 is provided in antenna device 101 according to the first exemplary embodiment. As described above, according to characteristics PY2 corresponding to the first exemplary embodiment, the center of the operating frequency is shifted further to the low-frequency side (e.g., 2400 MHz to 2450 MHz) as compared with characteristics PY0 corresponding to the comparative example. Thus, for example, to configure an antenna device corresponding to the radio frequency (2.4 GHz band described above) of Bluetooth (registered trademark), characteristics PY2 can be said more suitable than characteristics PY0. Thus, antenna device 101 according to the first exemplary embodiment enables performing radio communication corresponding to, for example, the radio frequency of Bluetooth (registered trademark) (2.4 GHz band described above).

As described above, antenna device 101 according to the first exemplary embodiment includes a feeding antenna conductor (e.g., antenna conductor 2), a non-feeding antenna conductor (e.g., antenna conductor 3), ground conductor 10, and an artificial magnetic conductor (e.g., AMC 8) interposed between ground conductor 10, and the feeding antenna conductor and the non-feeding antenna conductor. Antenna device 101 further includes a conductor (e.g., via conductor V1) at a position separated from the non-feeding antenna conductor (e.g., antenna conductor 3) in a direction opposite to the feeding antenna conductor (e.g., antenna conductor 2) to electrically connect AMC 8 to ground conductor 10. The conductor referred to here may be paraphrased as a connecting conductor because it is electrically connected to both AMC 8 and ground conductor 10, or may be paraphrased as a through-conductor because it passes through both AMC 8 and ground conductor 10 (refer to FIG. 2).

As a result, when antenna device 101 is provided with via conductor V1, the operating frequency of antenna device 101 is shifted further to the low-frequency side as compared with when via conductor V1 is not provided. Thus, when via conductor V1 is provided, AMC 8 of antenna device 101 can be shortened, and thus printed-circuit board 1 can be made smaller. That is, antenna device 101 can be miniaturized. In other words, antenna device 101 can be miniaturized while frequency characteristics of a fundamental wave at the operating frequency is maintained.

Via conductor V1 is one via conductor that is electrically connected to AMC 8 and ground conductor 10. This enables via conductor V1 that can be electrically connected to both AMC 8 and ground conductor 10 to be easily formed with one conductor.

At least the non-feeding antenna conductor (e.g., antenna conductor 3) is formed in a substantially rectangular shape. Via conductor V1 is disposed at a position separated from the feeding-side end of the non-feeding antenna conductor (e.g., antenna conductor 3), or from a position of a contact point where via conductor 5 is in contact with antenna conductor 3, by about length L3 that is about half of a length (e.g., L1 in FIG. 3) of one side in the longitudinal direction of the non-feeding antenna conductor (e.g., antenna conductor 3). As a result, antenna device 101 includes via conductor V1 that is disposed at a position separated from antenna conductor 3 in +z-direction (i.e., the direction opposite to antenna conductor 2). Thus, when the path of the current flowing from antenna conductor 3 to AMC 8 and ground conductor 10 is changed to cover a wider area, the operating frequency of antenna device 101 can be shifted to the low-frequency side.

Via conductor V1 is disposed at a position that is adjustable within a range from the leading-side end of the non-feeding antenna conductor (e.g., antenna conductor 3) by a predetermined length (L2) shorter than one side length (e.g., L1 in FIG. 3) in the longitudinal direction of the non-feeding antenna conductor (e.g., antenna conductor 3). As a result, when via conductor V1 is appropriately adjusted in position within the range of length L2, VSWR characteristics matching a desired operating frequency of antenna device 101 can be obtained. This allows radio communication at the desired operating frequency to be feasible.

Antenna device 101 also includes slit 81 of AMC 8, being formed at a position substantially facing a position between the feeding antenna conductor (e.g., antenna conductor 2) and the non-feeding antenna conductor (e.g., antenna conductor 3). This enables antenna device 101 to increase a gain of the dipole antenna downsized.

Antenna device 101 further includes parasitic conductor 6 provided on a board (e.g., dielectric board 7) on which the feeding antenna conductor (e.g., antenna conductor 2) and the non-feeding antenna conductor (e.g., antenna conductor 3) are disposed. This enables parasitic conductor 6 to increase capacitance between antenna conductors 2, 3 and AMC 8 to shift the operating frequency of antenna device 101 to the low-frequency side. Thus, even when antenna device 101 is downsized, antenna device 101 can transmit and receive a radio wave having a radio frequency in the fundamental wave band (2.4 GHz band).

Second Exemplary Embodiment

The configuration of the first exemplary embodiment requires adjusting a position of via conductor V1 that electrically connects AMC 8 to ground conductor 10, and adjusting a length of one side of AMC 8 in the longitudinal direction (e.g., L1 illustrated in FIG. 3). This causes printed-circuit board 1 of antenna device 101 to be less likely to have a standardized length, so that printed-circuit board 1 needs to be individually remade to manufacture antenna device 101 corresponding to a desired operating frequency. Thus, a second exemplary embodiment shows an example of antenna device 102 that can be easily adjusted to a desired operating frequency without requiring printed-circuit board 1 to be remade.

Figure 4:
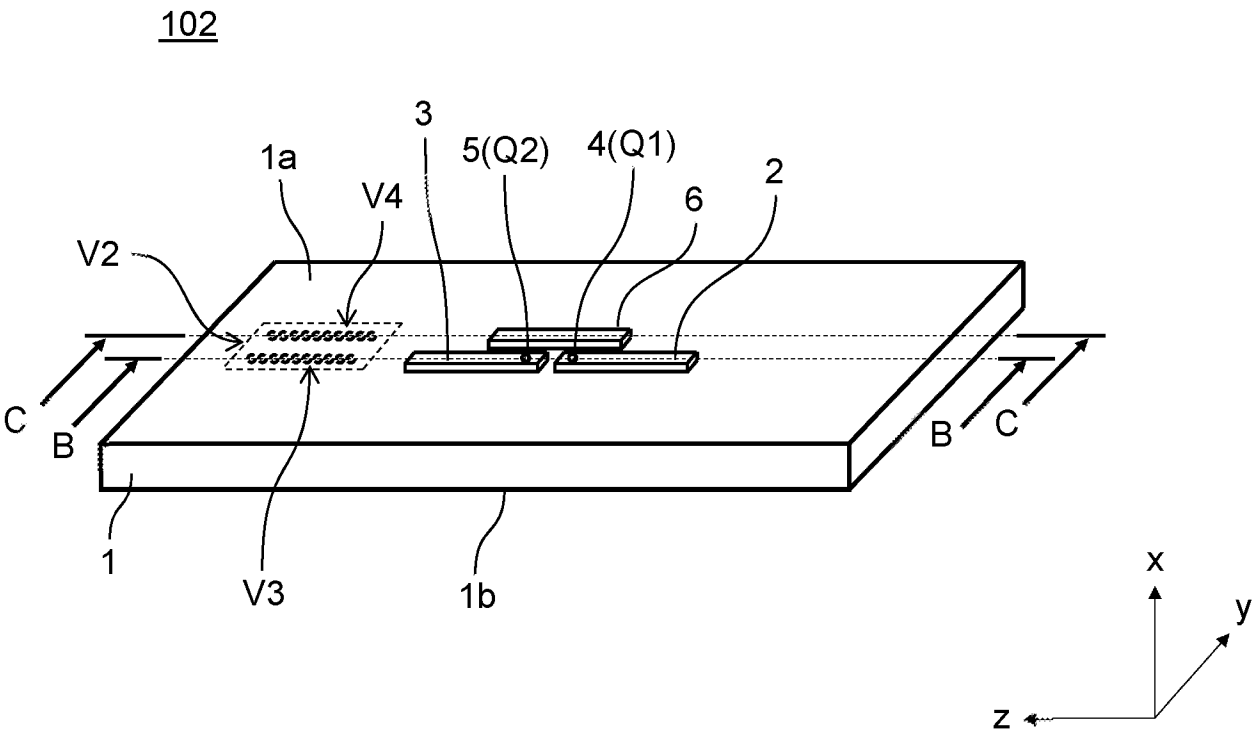
FIG. 4 is a perspective view illustrating an outer appearance of an antenna device according to a second exemplary embodiment.
Figure 5:
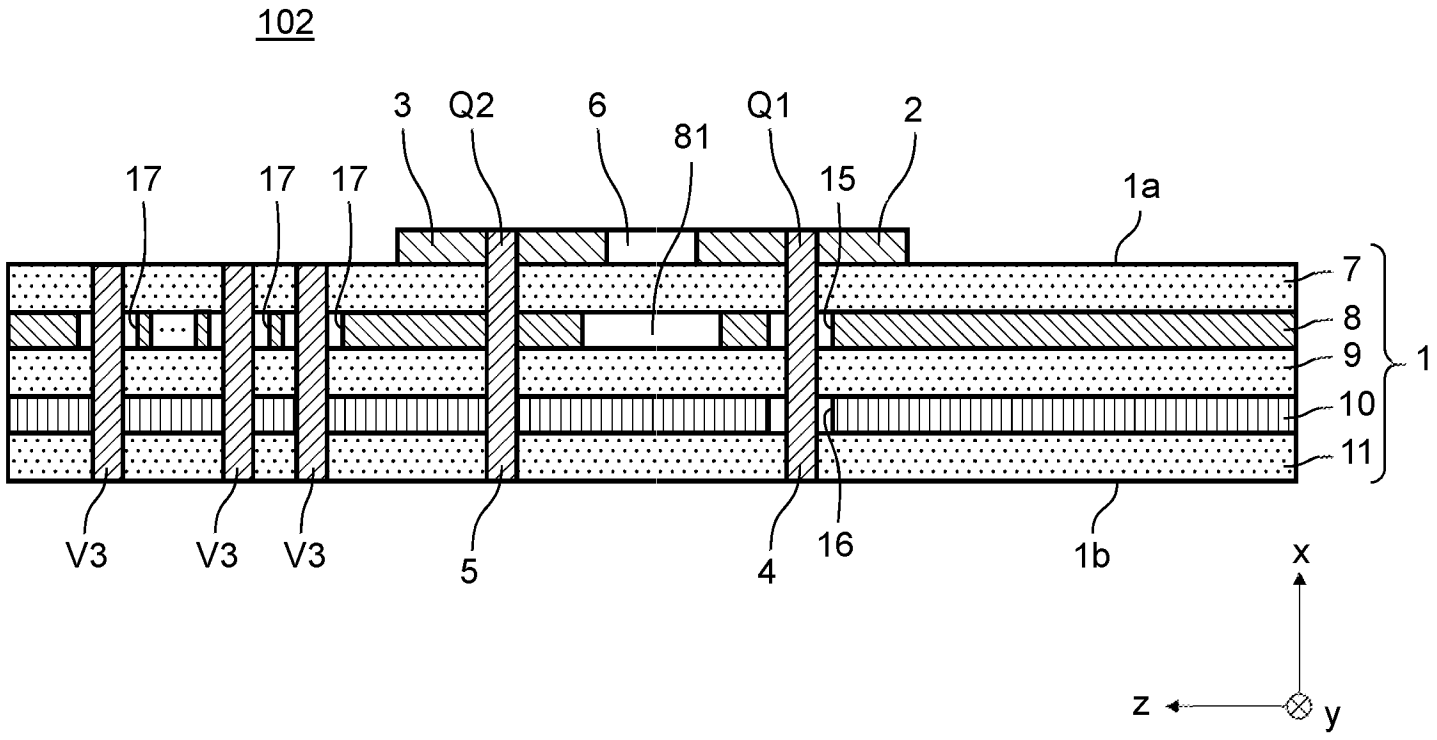
FIG. 5 is a longitudinal sectional view illustrating an internal structure of the antenna device taken along line B-B of FIG. 4.
Figure 6:
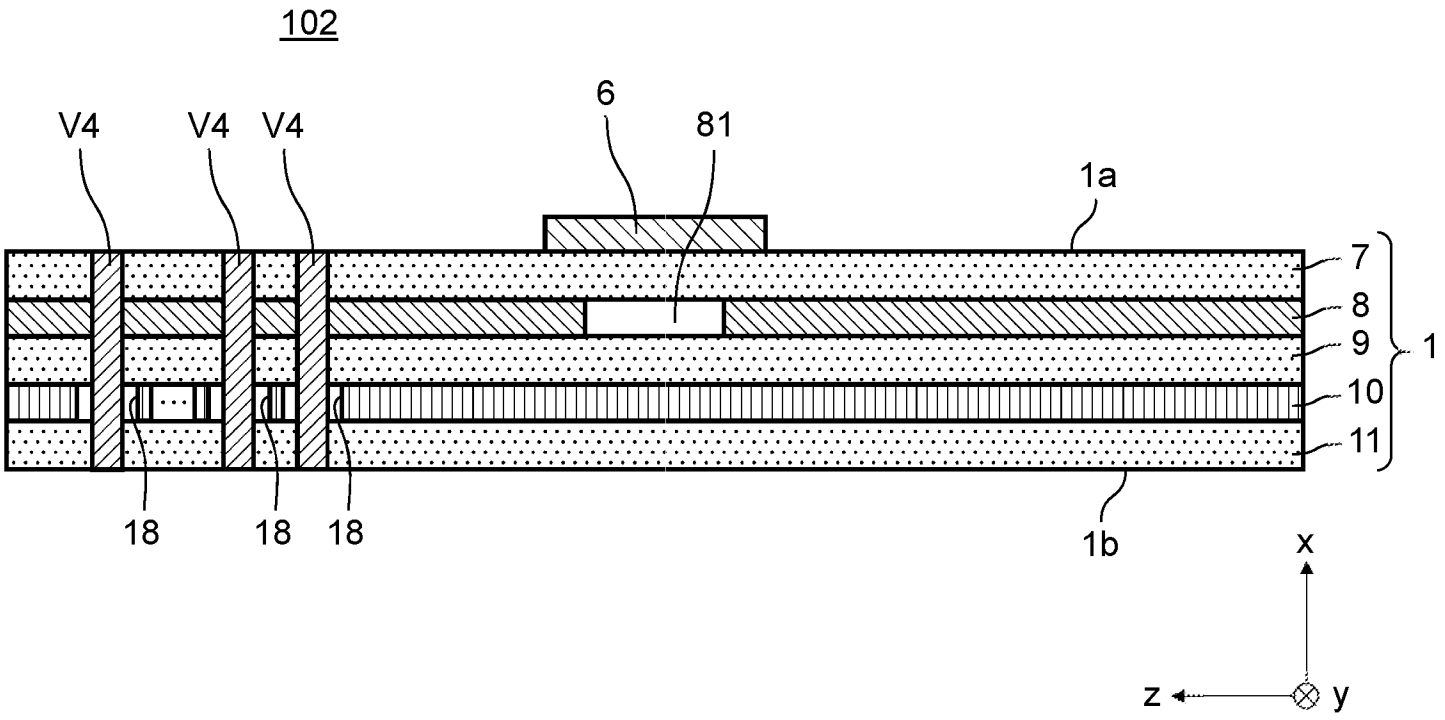
FIG. 6 is a longitudinal sectional view illustrating an internal structure of the antenna device taken along line C-C of FIG. 4.
Figure 7:
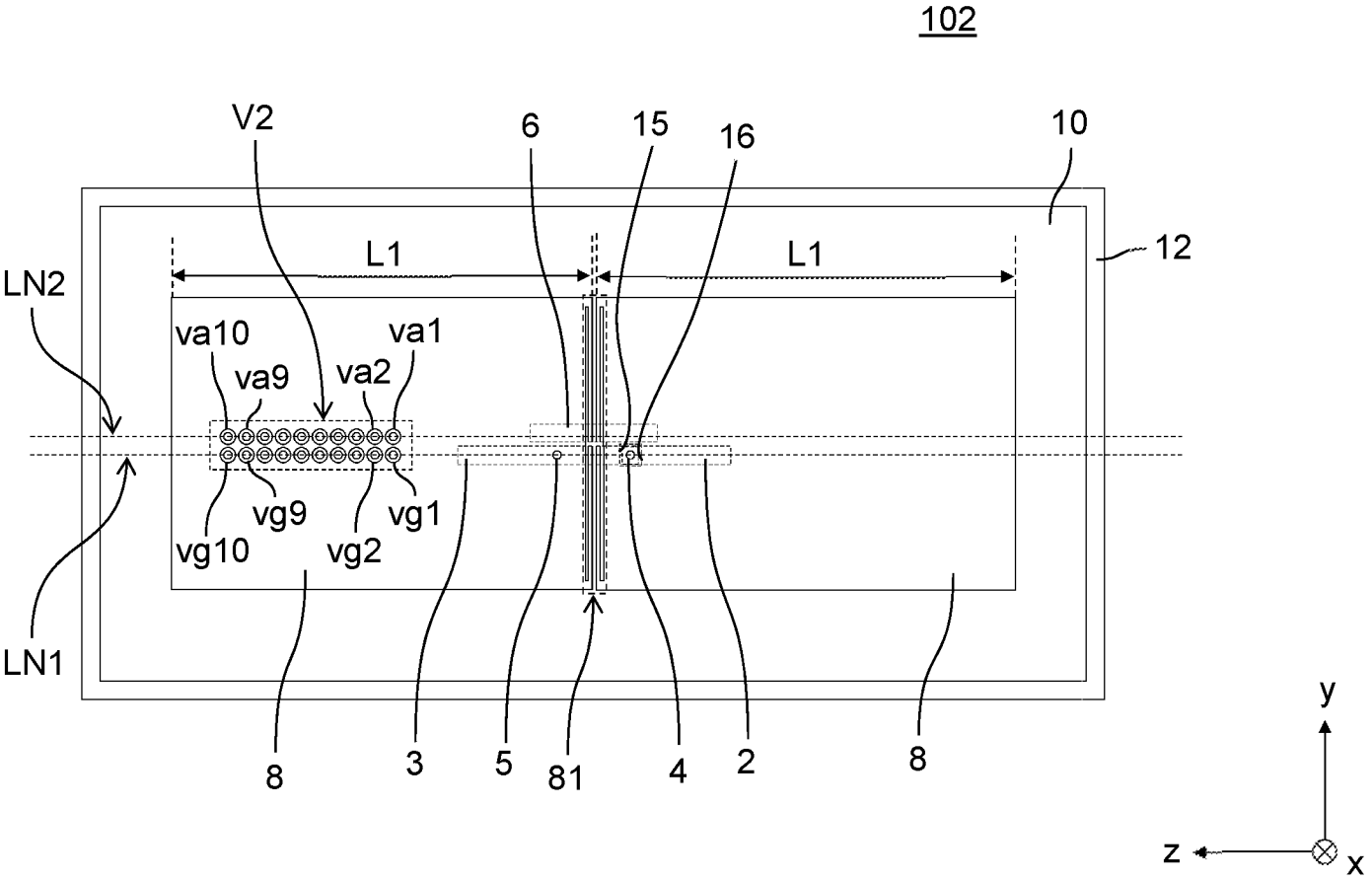
FIG. 7 is a perspective plan view of the antenna device according to the second exemplary embodiment as viewed from above.
Figure 8:
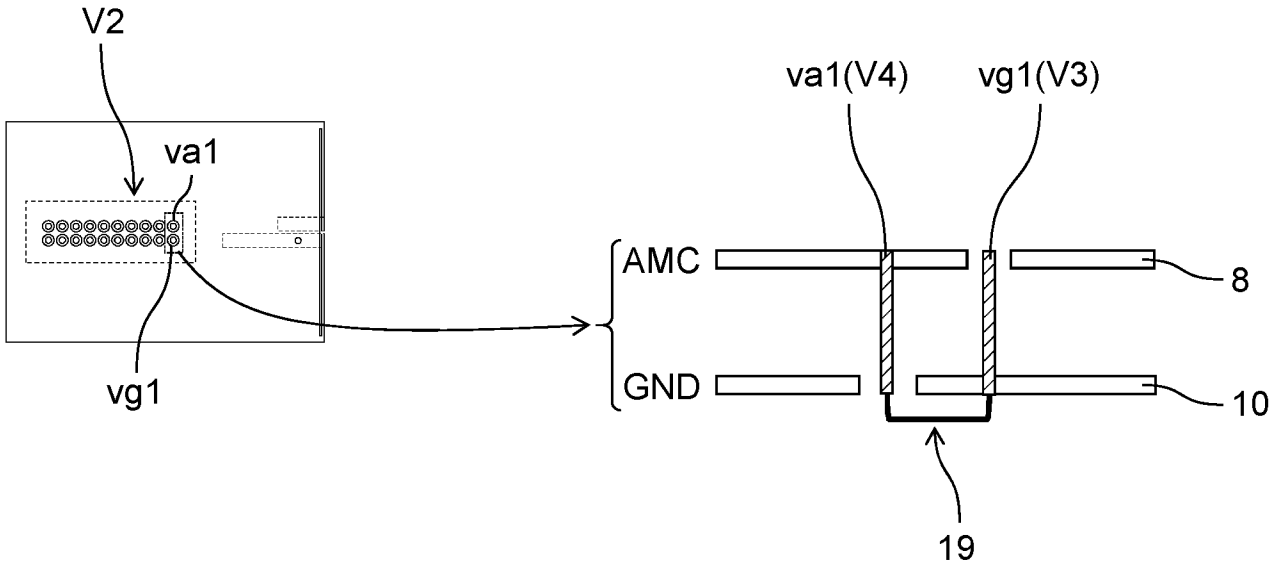
FIG. 8 is an explanatory diagram of an example of conduction between an artificial magnetic conductor (AMC) and a ground conductor.
Figure 9:
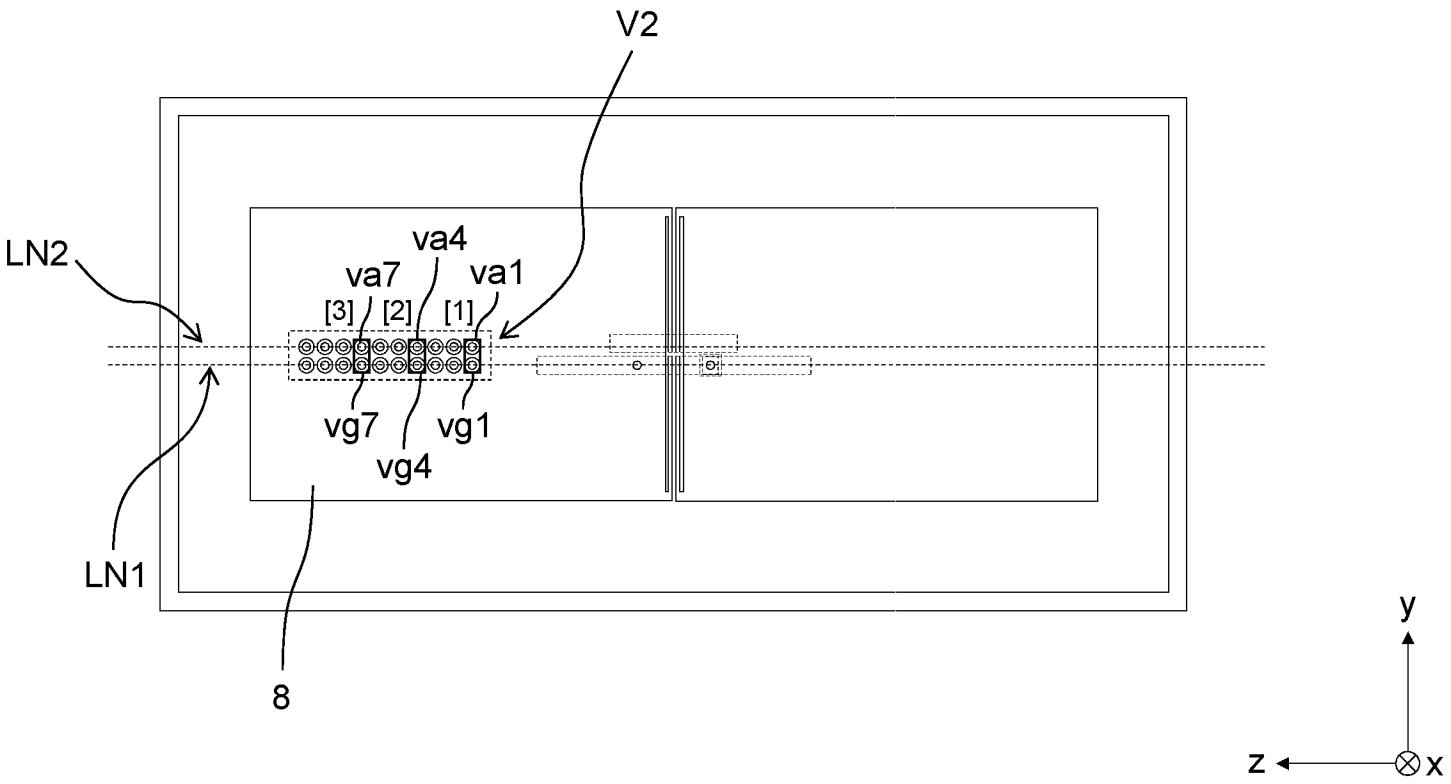
FIG. 9 is an explanatory diagram of an example of a conduction point between the AMC and the ground conductor.

FIG. 4 is a perspective view illustrating an outer appearance of antenna device 102 according to the second exemplary embodiment. FIG. 5 is a sectional view illustrating an internal structure of antenna device 102 taken along line B-B of FIG. 4. FIG. 6 is a sectional view illustrating an internal structure of antenna device 102 taken along line C-C of FIG. 4. FIG. 7 is a perspective plan view of antenna device 102 according to the second embodiment as viewed from above. FIG. 8 is an explanatory diagram of an example of conduction between AMC 8 and ground conductor 10. FIG. 9 is an explanatory diagram of an example of a conduction point between AMC 8 and ground conductor 10. In the description of FIGS. 4 to 9, the same elements as those of FIGS. 1 to 3 are designated by the same reference numerals to simplify or eliminate description, and different contents will be described.

In the second exemplary embodiment, an x-axis, a y-axis, and a z-axis follow an illustration in FIG. 4. The x-axis indicates a thickness direction of printed-circuit board 1 of antenna device 102. The y-axis indicates a width direction of printed-circuit board 1 of antenna device 102. The z-axis indicates a longitudinal direction of printed-circuit board 1 of antenna device 102.

As illustrated in FIG. 4, antenna device 102 includes printed-circuit board 1, antenna conductor 2 that is a strip conductor as an example of a feeding antenna, antenna conductor 3 that is a strip conductor as an example of a non-feeding antenna, and parasitic conductor 6 that is disposed laterally to antenna conductors 2, 3. Printed-circuit board 1 of antenna device 102 is mounted on a printed-circuit board of an electronic device such as a seat monitor.

In the second exemplary embodiment, via conductor group V2 composed of a plurality of via conductors is provided at a position separated from antenna conductor 3 in a direction opposite to antenna conductor 2 (+z-direction). Via conductor group V2 includes a total of twenty via conductors in which, for example, two via conductors V3, V4 arranged in y-axis direction form one set (pair), and ten pairs of via conductors V3, V4 including the one pair are arranged in z-axis direction. It is needless to say that a number of via conductors constituting via conductor group V2 is not limited to twenty.

Each pair of via conductors V3, V4 constituting via conductor group V2 is formed by using, for example, conductive copper foil. Via conductor V3 is electrically connected to only ground conductor 10 (refer to FIG. 5). Via conductor V4 is electrically connected to only AMC 8 (refer to FIG. 6). Via conductors V3 and V4 are connected by, for example, zero-ohm resistor 19 (refer to FIG. 8). As with the first exemplary embodiment, this enables antenna device 102 according to the second exemplary embodiment to dispose one via conductor that is substantially electrically connected to both of AMC 8 and ground conductor 10 at a position separated from antenna conductor 3 in a direction opposite to antenna conductor 2 (+z-direction). Thus, as with the first exemplary embodiment, the operating frequency of antenna device 102 can be shifted further to the low-frequency side as compared with when one via conductor that is substantially connected to both of AMC 8 and ground conductor 10 is not provided. Additionally, although details will be described later, the second exemplary embodiment allows a placement position of one via conductor (i.e., a pair of via conductors V3, V4) that is substantially electrically connected to both of AMC 8 and ground conductor 10 to be appropriately adjusted in z-axis direction.

FIG. 5 illustrates a longitudinal sectional view of antenna device 102 taken along line B-B of FIG. 4. Although FIG. 4 illustrates a total of ten via conductors V3 provided in the axial direction, FIG. 5 excerpts and illustrates only three via conductors V3, for example, to simplify the illustration. As described above, via conductor V3 is electrically connected to only ground conductor 10 and is electrically insulated from AMC 8.

AMC 8 also includes a hole for slit 81, via conductor insulating hole 15 formed to allow via conductor 4 to pass through while being electrically insulated from AMC 8, a hole that allows via conductor 5 to pass through and is electrically connected to AMC 8, and via conductor insulating hole 17 formed to allow via conductor V3 to pass through while being electrically insulated from AMC 8. Via conductor insulating hole 17 is provided for each via conductor V3, and thus via conductor insulating holes 17 are provided at, for example, ten places.

Ground conductor 10 includes via conductor insulating hole 16 formed to allow via conductor 4 to pass through while being electrically insulated from ground conductor 10, a first hole that allows via conductor 5 to pass through and is electrically connected to ground conductor 10, and a second hole that allows via conductor V3 to pass through and is electrically connected to ground conductor 10. The second hole is provided for each via conductor V3, and thus the second holes are provided at, for example, ten places.

FIG. 6 illustrates a longitudinal sectional view of antenna device 102 taken along line C-C of FIG. 4. Although FIG. 4 illustrates a total of ten via conductors V4 provided in the axial direction, FIG. 6 excerpts and illustrates only three via conductors V4, for example, to simplify the illustration. As described above, via conductor V4 is electrically connected to only AMC 8 and is electrically insulated from ground conductor 10. Note that parasitic conductor 6 is provided along a direction of line C-C in FIG. 4.

AMC 8 is provided with a first hole for slit 81 and a second hole that allows via conductor V4 to pass through and is electrically connected to AMC 8. The second hole is provided for each via conductor V4, and thus the second holes are provided at, for example, ten places.

Ground conductor 10 is provided with via conductor insulating hole 18 formed to allow via conductor V4 to pass through while being electrically insulating from ground conductor 10. Via conductor insulating hole 18 is provided for each via conductor V4, and thus via conductor insulating holes 18 are provided at, for example, ten places.

FIG. 7 mainly illustrates AMC 8 and ground conductor 10, in plan view, and thus antenna conductors 2, 3, parasitic conductor 6, and via conductor insulating holes 15, 16 are each illustrated with a broken line to be transparently illustrated. As illustrated in FIG. 7, via conductor group V2 includes a pair of via conductors (vg1, va1) disposed closest to antenna conductor 3, a pair of via conductors (vg2, va2), . . . , a pair of via conductors (vg9, va9), and a pair of via conductors (vg10, va10) disposed farthest from antenna conductor 3. Each of via conductors vg1 to vg10 is the same as via conductor V3, and each of via conductors va1 to va10 is the same as via conductor V4.

Via conductors vg1 to vg10, which are electrically connected to only ground conductor 10, are disposed along virtual line LN1 (an example of a first virtual line) as with antenna conductors 2, 3. In contrast, via conductors va1 to va10, which are electrically connected to only AMC 8, are disposed along virtual line LN2 (an example of a second virtual line) as with parasitic conductor 6. Here, the virtual line LN2 is parallel to the virtual line LN1. That is, as illustrated in FIG. 7, antenna conductors 2, 3, via conductor vg1 (an example of a second via conductor), and via conductor vg2 (an example of a fourth via conductor) are disposed along virtual line LN1. Parasitic conductor 6, via conductor va1 (an example of a first via conductor), and via conductor vat (an example of a third via conductor) are disposed along virtual line LN2.

FIG. 8 illustrates an example of conduction of one pair of via conductor group V2 (e.g., a pair of via conductors vg1, va1), AMC 8, and ground conductor 10. In the pair of via conductors vg1, va1, via conductor vg1 and via conductor va1 are electrically connected to each other with zero-ohm resistor 19, for example. Zero-ohm resistor 19 is an electronic component having a resistance value of zero, and is composed of, for example, a lead resistor or a chip resistor. Via conductor vg1 and via conductor va1 may be connected to each other with another conductive component having a resistance value other than zero. Similarly, in each pair of conductors, the conductors may also be electrically connected to each other.

Next, an example of VSWR characteristics of antenna device 102 according to the second exemplary embodiment will be described with reference to FIG. 10.

As described above, characteristics PY0 indicate the VSWR characteristics when via conductor group V2 is not provided in antenna device 102 according to the second exemplary embodiment (i.e., the VSWR characteristics of a comparative example). Characteristics PY1 indicate the VSWR characteristics when the pair of via conductors vg1, va1 of via conductor group V2 are electrically connected to each other in antenna device 102 according to the second exemplary embodiment (refer to FIG. 9).

Characteristics PY2 indicate the VSWR characteristics when the pair of via conductors vg4, va4 of via conductor group V2 are electrically connected to each other in antenna device 102 according to the second exemplary embodiment (refer to FIG. 9). Characteristics PY3 indicate the VSWR characteristics when the pair of via conductors vg7, va7 of via conductor group V2 are electrically connected to each other in antenna device 102 according to the second exemplary embodiment (refer to FIG. 9).

The pair of via conductors vg4, va4 are identical in placement position to via conductor V1 according to the first exemplary embodiment. Thus, each of the VSWR characteristics of antenna device 101 according to the first exemplary embodiment and the VSWR characteristics of antenna device 102 according to the second exemplary embodiment when the pair of via conductors vg4, va4 are electrically connected to each other corresponds to characteristics PY2.

According to characteristics PY1, PY2, and PY3 corresponding to the second exemplary embodiment, the center of the operating frequency is shifted further to the low-frequency side (e.g., 2400 MHz, 2430 MHz, 2470 MHz) as compared with characteristics PY0 corresponding to the comparative example. Thus, for example, to configure an antenna device corresponding to the radio frequency (2.4 GHz band described above) of Bluetooth (registered trademark), characteristics PY1, PY2, PY3 can be said more suitable than characteristics PY0. Thus, antenna device 102 according to the second exemplary embodiment enables performing radio communication corresponding to, for example, the radio frequency of Bluetooth (registered trademark) (2.4 GHz band described above). The second exemplary embodiment does not require printed-circuit board 1 of antenna device 102 to be individually remade, and enables antenna device 102 to be easily adjusted to a desired operating frequency by selecting any pair of via conductors to be electrically connected to each other from among the pair of via conductors vg1, va1 to the pair of via conductors vg10, va10.

As described above, antenna device 102 according to the second exemplary embodiment has via conductors (e.g., via conductor group V2) including the first via conductor (e.g., via conductor V4) that is electrically connected to only the AMC and the second via conductor (e.g., via conductor V3) that is electrically connected to only ground conductor 10. The first via conductor (e.g., via conductor va1 corresponding to via conductor V4) and the second via conductor (e.g., via conductor vg1 corresponding to via conductor V3), which constitute a pair arranged in y-axis direction, are connected to be able to be electrically connected to each other. As a result, as with the first exemplary embodiment, the operating frequency of antenna device 102 is shifted further to the low-frequency side as compared with when the first via conductor and the second via conductor, which are electrically connected to each other, are not provided. Thus, when via conductor V1 is provided, AMC 8 of antenna device 101 can be shortened, and thus printed-circuit board 1 can be made smaller, i.e., antenna device 101 can be miniaturized. In other words, antenna device 101 can be miniaturized while frequency characteristics of a fundamental wave at the operating frequency is maintained.

Multiple pairs each having the first via conductor (e.g., via conductor V4) and the second via conductor (e.g., via conductor V3) are disposed separated from a non-feeding antenna conductor (e.g., antenna conductor 3) in a direction opposite to a feeding antenna conductor (e.g., antenna conductor 2) (+z-axis direction). As a result, printed-circuit board 1 of antenna device 102 is not required to be individually remade, so that antenna device 102 can be easily adjusted to a desired operating frequency by selecting any pair of via conductors to be electrically connected to each other from among the pair of via conductors vg1, va1 to the pair of via conductors vg10, va10 on identical printed-circuit board 1.

Antenna device 102 also includes slit 81 of AMC 8, being formed at a position substantially facing a position between the feeding antenna conductor (e.g., antenna conductor 2) and the non-feeding antenna conductor (e.g., antenna conductor 3). This enables antenna device 102 to increase a gain of the dipole antenna downsized.

Antenna device 102 further includes parasitic conductor 6 provided on a board (e.g., dielectric board 7) on which the feeding antenna conductor (e.g., antenna conductor 2) and the non-feeding antenna conductor (e.g., antenna conductor 3) are disposed. This enables parasitic conductor 6 to increase capacitance between antenna conductors 2, 3 and AMC 8 to shift the operating frequency of antenna device 102 to the low-frequency side. Thus, even when antenna device 102 is miniaturized, antenna device 102 can transmit and receive a radio wave having a radio frequency in the fundamental wave band (2.4 GHz band).

Although various exemplary embodiments have been described above with reference to the drawings, it is needless to say that the present disclosure is not limited to such examples. It is obvious to those skilled in the art that various modification examples, alteration examples, substitution examples, addition examples, deletion examples, and equivalent examples can be conceived within the scope of claims, and thus it is obviously understood that those examples belong to the technical scope of the present disclosure. Additionally, each component in the various exemplary embodiments described above may be appropriately combined without departing from the spirit of the disclosure.

The first and second exemplary embodiments described above each show an example in which antenna device 101, 102 is mounted in a seat monitor installed in an aircraft. However, the present disclosure is not limited to the seat monitor, and antenna device 101, 102 may be mounted in many Internet Of Things (IoT) devices such as a cordless phone master unit or a slave unit, an electronic shelf label (e.g., a card-type electronic device that is attached to a display shelf of a retail store, and displays a selling price of a product), a smart speaker, an in-vehicle device, a microwave oven, and a refrigerator.

Although antenna devices 101, 102 according to the first and second exemplary embodiments described above are each described as an example of an antenna device capable of both transmitting and receiving a radio wave, the present disclosure may be applied to, for example, an antenna device designed for transmission or reception.

The present disclosure is useful as an antenna device that achieves miniaturization while maintaining frequency characteristics of a fundamental wave at an operating frequency.

What is claimed is:

1. An antenna device comprising:

a feeding antenna conductor;

a non-feeding antenna conductor;

a ground conductor;

an artificial magnetic conductor disposed between (i) the feeding antenna conductor and the non-feeding antenna conductor, and (ii) the ground conductor; and a conductor that electrically connects the artificial magnetic conductor to the ground conductor, the conductor being disposed at a position opposite to the feeding antenna conductor with respect to the non-feeding antenna conductor, and being separated from the non-feeding antenna conductor.

2. The antenna device according to claim 1, wherein the conductor is one via conductor that is electrically connected to the artificial magnetic conductor and the ground conductor.

3. The antenna device according to claim 1, wherein
the non-feeding antenna conductor is formed in a substantially rectangular shape,
the artificial magnetic conductor has one side in a longitudinal direction, and
the position of the conductor is separated from a feeding-side end of the non-feeding antenna conductor by about half of a length of the one side of the artificial magnetic conductor.

4. The antenna device according to claim 3, wherein the position of the conductor is within a predetermined length shorter than the length of the one side from a leading-side end of the non-feeding antenna conductor.

5. The antenna device according to claim 1, wherein
the conductor includes:
a first via conductor that is electrically connected to the artificial magnetic conductor and is electrically insulated from the ground conductor, and
a second via conductor that is electrically connected to the ground conductor and is electrically insulated from the artificial magnetic conductor.

6. The antenna device according to claim 5, wherein
the conductor includes a plurality of pairs each having the first via conductor and the second via conductor, and
the plurality of pairs is disposed at a position opposite to the feeding antenna conductor with respect to the non-feeding antenna conductor, and is separated from the non-feeding antenna.

7. The antenna device according to claim 1, wherein the artificial magnetic conductor includes a slit formed at a position substantially facing a position between the feeding antenna conductor and the non-feeding antenna conductor.

8. The antenna device according to claim 1, further comprising:
a board on which the feeding antenna conductor and the non-feeding antenna conductor are disposed; and
a parasitic conductor provided on the board.

9. The antenna device according to claim 8, wherein
the conductor includes:
a first via conductor that is electrically connected to the artificial magnetic conductor and is electrically insulated from the ground conductor, and
a second via conductor that is electrically connected to the ground conductor and is electrically insulated from the artificial magnetic conductor,
the feeding antenna conductor, the non-feeding antenna conductor, and the second via conductor are disposed along a first virtual line, and
the parasitic conductor and the first via conductor are disposed along a second virtual line parallel to the first virtual line.

10. The antenna device according to claim 9, wherein
the conductor further includes:
a third via conductor that is electrically connected to the artificial magnetic conductor and is electrically insulated from the ground conductor, and
a fourth via conductor that is electrically connected to the ground conductor and is electrically insulated from the artificial magnetic conductor,
the fourth via conductor is disposed on the first virtual line, and
the third via conductor is disposed on the second virtual line.

11. The antenna device according to claim 1, further comprising a via conductor that is electrically connected to the feeding antenna conductor, the via conductor being electrically insulated from the ground conductor and the artificial magnetic conductor.

12. The antenna device according to claim 1, further comprising a via conductor that is electrically connected to the non-feeding antenna conductor, the via conductor being electrically connected to the ground conductor and the artificial magnetic conductor.

13. The antenna device according to claim 12, wherein
the non-feeding antenna includes:
a feeding-side end facing the feeding antenna, and
a leading-side end that is opposite to the feeding-side end, and
the via conductor is electrically connected to the non-feeding antenna conductor at a position closer to the feeding-side end than to the leading-side end.

14. The antenna device according to claim 1, wherein
the artificial magnetic conductor includes:
a first artificial magnetic conductor disposed between the feeding antenna conductor and the ground conductor,
a second artificial magnetic conductor disposed between the non-feeding antenna conductor and the ground conductor, and
a slit located between the first artificial magnetic conductor and the second artificial magnetic conductor.

* * * * *